US011413837B2

(12) United States Patent
Wecker

(10) Patent No.: US 11,413,837 B2
(45) Date of Patent: Aug. 16, 2022

(54) TUNABLE SEED OIL EXPELLER PRESS

(71) Applicant: Andreas Wecker, Bend, OR (US)

(72) Inventor: Andreas Wecker, Bend, OR (US)

( * ) Notice: Subject to any disclaimer, the term of this patent is extended or adjusted under 35 U.S.C. 154(b) by 69 days.

(21) Appl. No.: 17/152,651

(22) Filed: Jan. 19, 2021

(65) Prior Publication Data

US 2021/0138751 A1 May 13, 2021

Related U.S. Application Data

(63) Continuation-in-part of application No. 16/565,228, filed on Sep. 9, 2019, which is a continuation-in-part of application No. 15/869,952, filed on Jan. 12, 2018, now abandoned.

(51) Int. Cl.

| | |
|---|---|
| ***B30B 9/12*** | (2006.01) |
| ***B30B 9/14*** | (2006.01) |
| ***B30B 9/18*** | (2006.01) |
| ***B30B 9/08*** | (2006.01) |
| ***B30B 15/30*** | (2006.01) |

(52) U.S. Cl.

CPC ..... *B30B 9/08* (2013.01); *B30B 9/12* (2013.01); *B30B 9/14* (2013.01); *B30B 9/18* (2013.01); *B30B 15/30* (2013.01); *B30B 9/127* (2013.01)

(58) Field of Classification Search

CPC .... B30B 9/02; B30B 9/08; B30B 9/12; B30B 9/122; B30B 9/127; B30B 9/14; B30B 9/18; B30B 11/24; B30B 11/246; B30B 15/30; A47J 19/025; C11B 1/06; A23N 1/02

USPC ..... 99/495, 501, 502, 505; 100/117

See application file for complete search history.

(56) References Cited

U.S. PATENT DOCUMENTS

| | | | | |
|---|---|---|---|---|
| 1,871,833 A * | 8/1932 | Anderson | B30B 11/227 | 100/98 R |
| 4,097,213 A * | 6/1978 | McComb | B30B 11/24 | 425/467 |
| 4,796,747 A * | 1/1989 | Kajiwara | A21C 11/20 | 198/535 |
| 5,452,650 A * | 9/1995 | Lee | A47J 19/025 | 366/291 |
| 8,474,374 B2 * | 7/2013 | Trovinger | A23N 1/02 | 99/503 |
| 8,863,656 B2 * | 10/2014 | Trovinger | A23N 1/02 | 100/145 |

(Continued)

*Primary Examiner* — Jimmy T Nguyen
(74) *Attorney, Agent, or Firm* — Mark S Hubert

(57) ABSTRACT

A low speed seed oil expeller press with the capability of extracting oil through a new design that does not crush or grind the seed so as to eliminate the need for filtration and maintain the seed oil at a temperature below 130 degrees F. The seed oil expeller press has a seed preheating capability and controls the pressure and extraction oil temperature by manipulation of the expeller speed, the head volume and the size of the pressed seed exit orifice. The seed oil expeller press eliminates seed rotation within the head volume so as to eliminate crushing, grinding or tearing of the seed by a symmetrical knifed press head. The seed oil expeller press regulates seed temperature, seed feed rate, seed pressure, seed rotation and extracted seed oil temperature so as to compensate for the seed size, seed hardness and seed oil content, so as to allow for seed compression without crushing or tearing to accomplish seed oil extraction at a low (cold press) temperature.

8 Claims, 18 Drawing Sheets

(56) References Cited

U.S. PATENT DOCUMENTS

| | | | | |
|---|---|---|---|---|
| 2007/0277682 | A1* | 12/2007 | Wong | A47J 19/025<br>99/495 |
| 2008/0092867 | A1* | 4/2008 | Yeh | F41B 11/52<br>124/82 |
| 2015/0230939 | A1* | 8/2015 | Froidevaux | B25B 5/163<br>29/256 |
| 2017/0107447 | A1* | 4/2017 | Hewitt | C11B 1/102 |

* cited by examiner

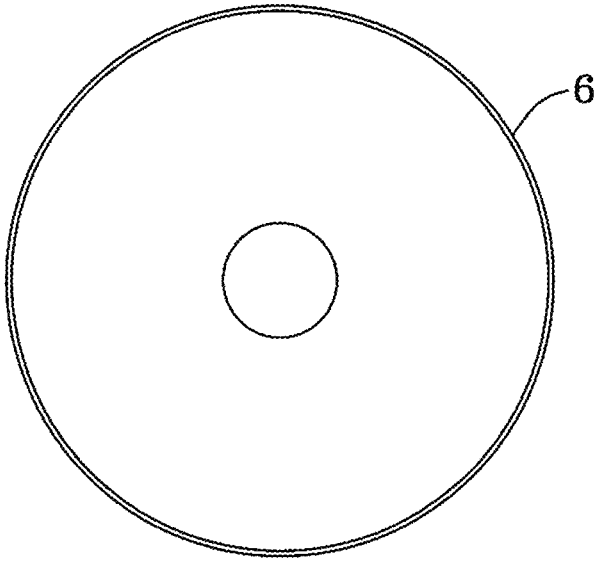
FIG. 8
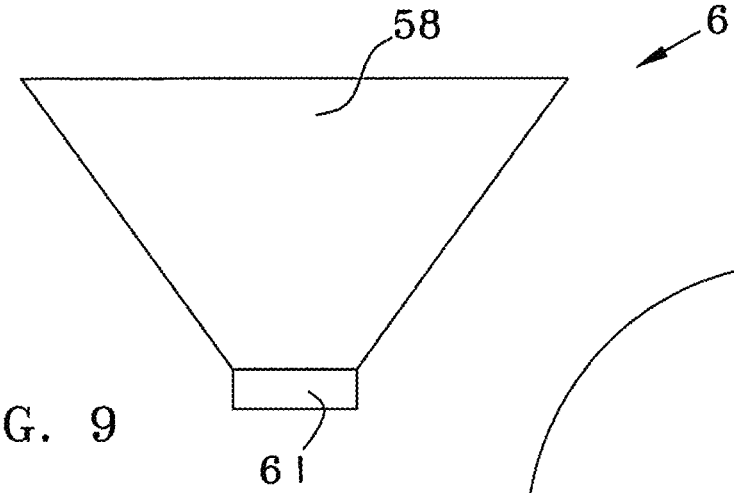
FIG. 9
FIG. 10
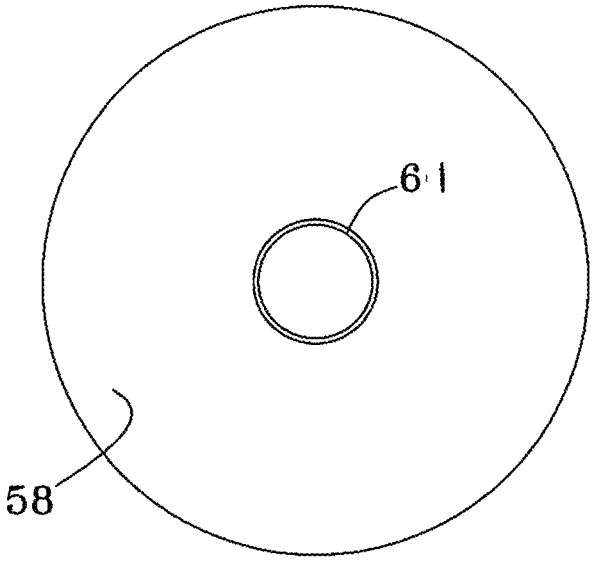

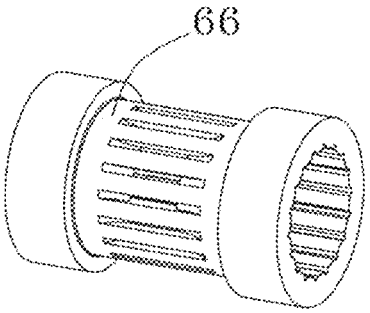
FIG. 46
FIG. 47
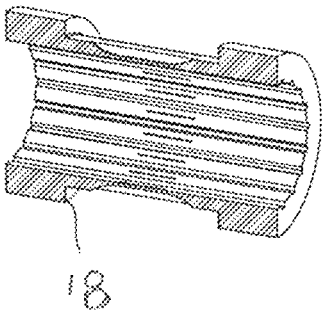
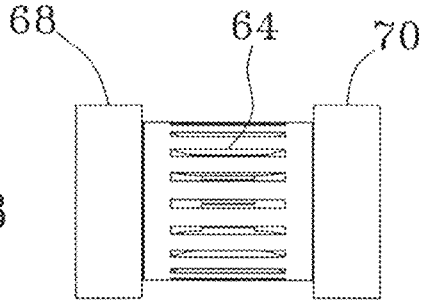
FIG. 48
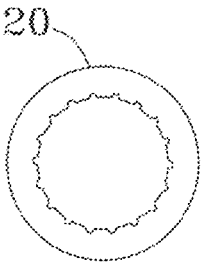
FIG. 49
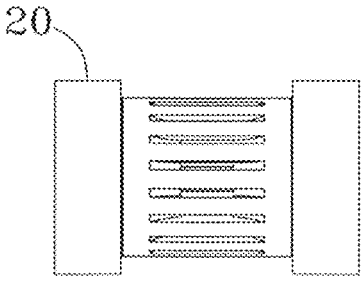
FIG. 50
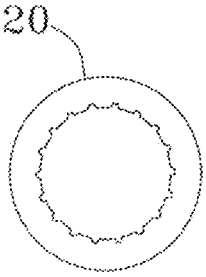
FIG. 51

FIG. 52
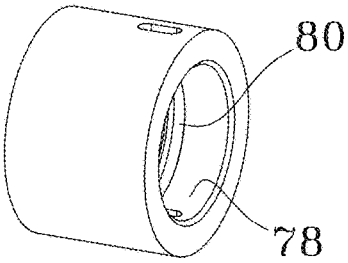
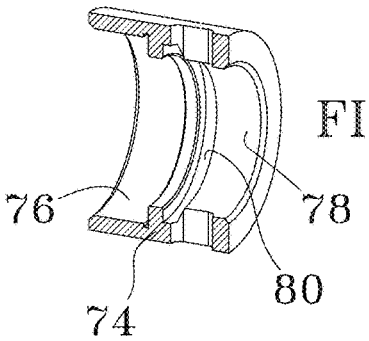
FIG. 53
FIG. 54
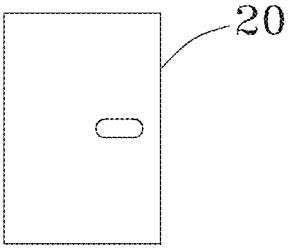
FIG. 55
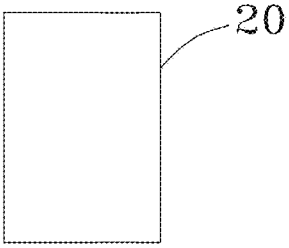
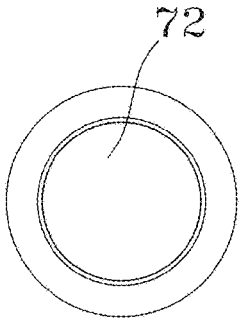
FIG. 56

FIG. 57
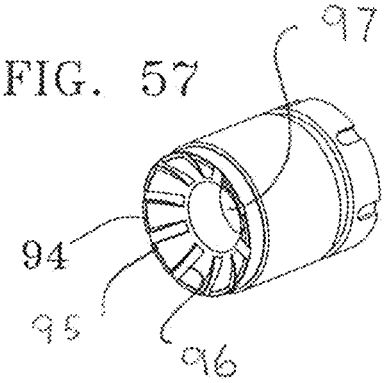
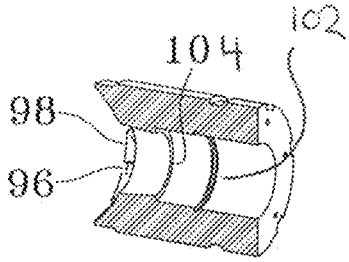
FIG. 58
FIG. 59
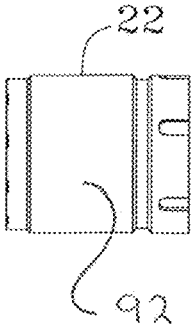
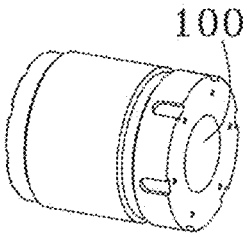
FIG. 60
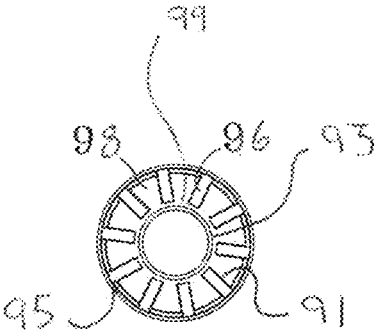
FIG. 61
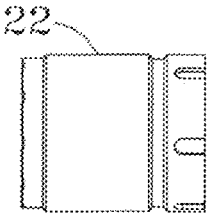
FIG. 62
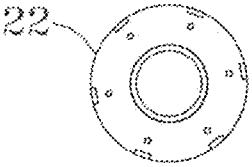
FIG. 63
FIG. 64
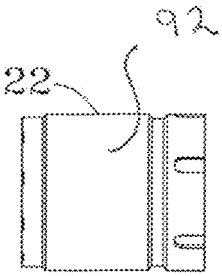

TUNABLE SEED OIL EXPELLER PRESS

CROSS-REFERENCE TO RELATED APPLICATIONS

THIS APPLICATION IS A CONTINUATION-IN-PART OF U.S. patent application Ser. No. 16/565,228, FILED Sep. 9, 2019, WHICH IS A CONTINUATION-IN-PART OF U.S. patent application Ser. No. 15/869,952, FILED Jan. 12, 2018, EACH OF WHICH IS INCORPORATED BY REFERENCE HEREIN IN ITS ENTIRETY.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a device for the extraction of oil from a seed, and more particularly to expeller press technology.

BACKGROUND

The basics of extracting oil from seeds is quite simple. Compress the seeds at a high pressure until they give up their oil, then filter the seeds from the extracted oil. Generally the seeds are fed from a hopper via a rotating auger feed, into a fixed volume extraction chamber where the seeds are compressed under abrasive rotation between the contact surfaces of the extraction chamber. This type of compression leads to crushing, grinding and tearing of the seed, and the generation of high temperatures which are passed on to the seed oil.

There are drawbacks with the conventional way seed oils are processed. The crushing tearing and grinding of the seed leaves residual seed particles in the seed oil, which must then be filtered. The high pressure on the seed raises the temperature of the oil extracted such that oxidation and catalytic conversion of the oil occurs (both highly undesirable characteristics of seed oil).

Henceforth, an improved seed oil expeller press that can be precisely tuned to ensure the maximum amount of oil expelled from the seed under cold press conditions without crushing or physical grinding of the seed so that filtration is not necessary, would fulfill a long felt need in the seed oil extraction industry. This new invention utilizes and combines known and new technologies in a unique and novel configuration to overcome the aforementioned problems and accomplish this.

BRIEF SUMMARY

In accordance with various embodiments, a fully tunable apparatus for extracting the maximum amount of cold press seed oil (below 130 degrees F.) within specific pressure and temperature limits are provided.

In one aspect, a seed oil expeller press with the capability of extracting oil through a new design that does not crush or grind the seed so as to eliminate the need for filtration is provided.

In another aspect, a seed oil expeller press capable of preheating the seeds, adjusting the control pressure and extraction oil temperature by manipulation of the expeller speed, the head volume and the size of the pressed seed exit orifice is provided.

In yet another aspect, a seed oil expeller press capable of eliminating seed rotation within the head volume so as to eliminate crushing, grinding or tearing of the seed by a symmetrical knifed press head is provided.

In yet another aspect, a seed oil expeller press that regulates seed temperature, seed feed rate, seed pressure, seed rotation and extracted seed oil temperature to compensate for the seed size, seed hardness and seed oil content, so as to allow for seed compression ("pressing") without crushing or tearing to accomplish seed oil extraction at a low (cold press) temperature.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIGS. 8-12 are top, side, bottom, side perspective and side views of the hopper;

FIGS. 46-51 are side perspective, side perspective cross sectional, top, back, side and front views of the transfer housing;

FIGS. 52-56 are side perspective, side perspective cross sectional, top, left and right side and front views of the head collar;

FIGS. 57-64 are left side, side perspective cross sectional, right side, front, back, and right side views of the press head;

DETAILED DESCRIPTION

Figure 1:
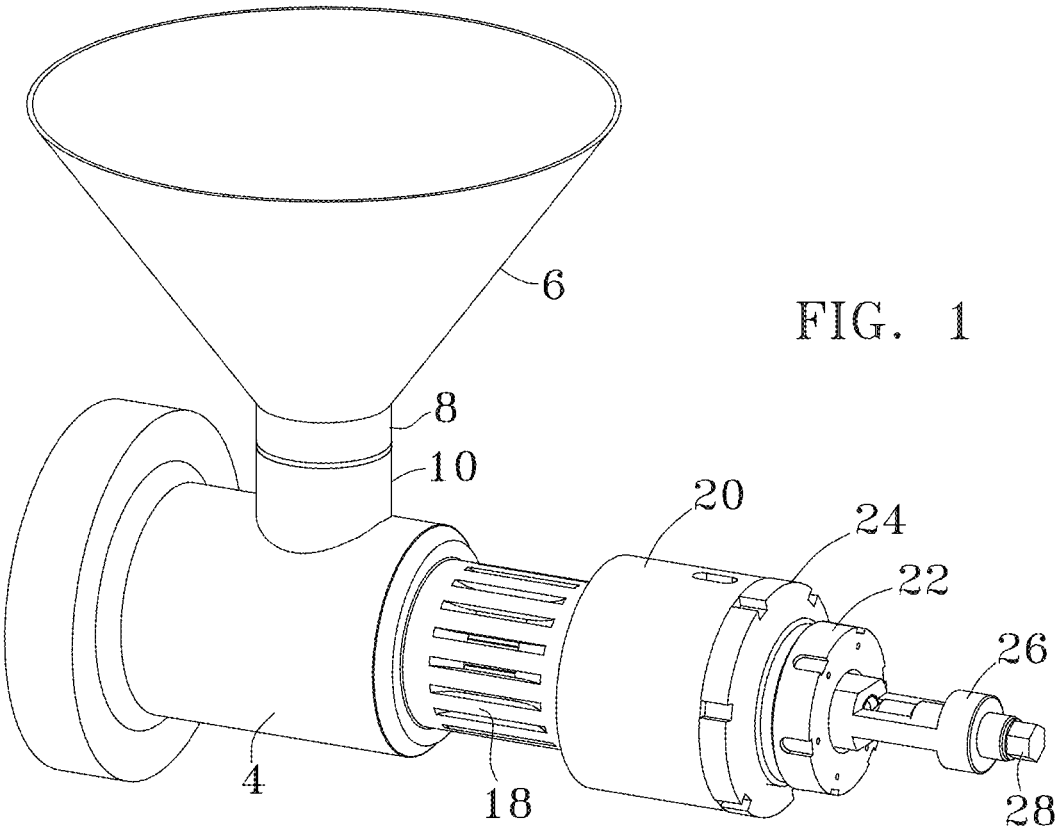
FIGS. 1-6 are perspective, side, top, front, back and bottom views of the seed oil press.
Figure 2:
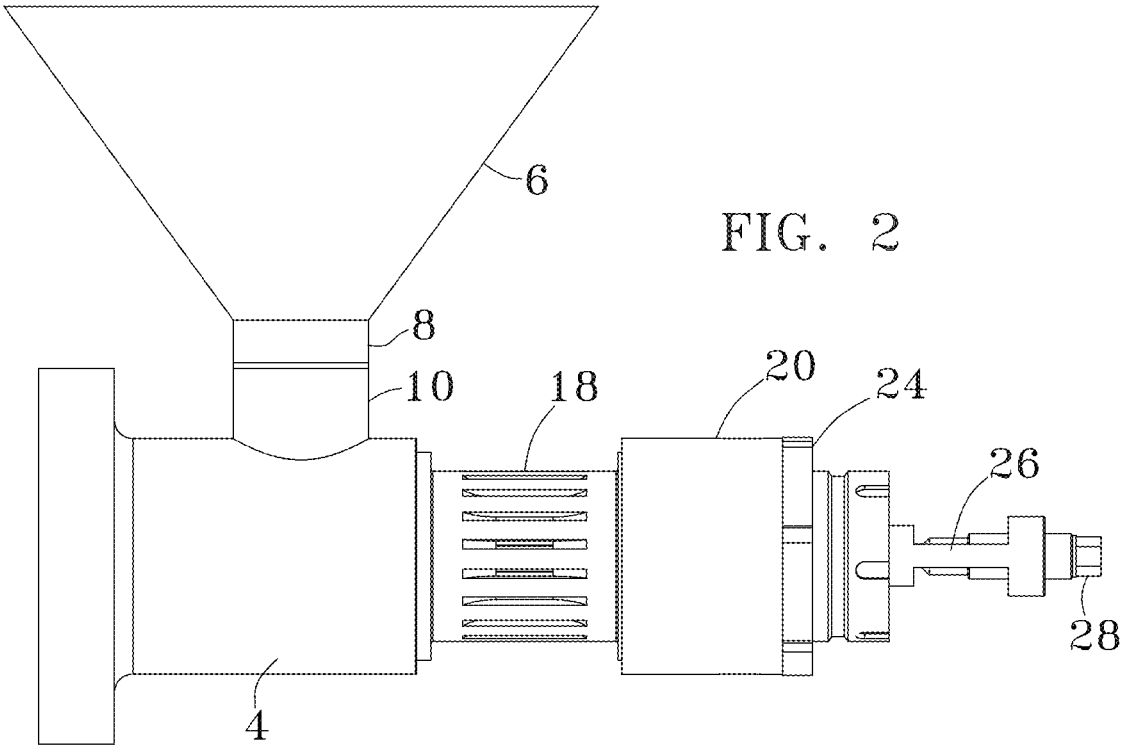
Figure 3:
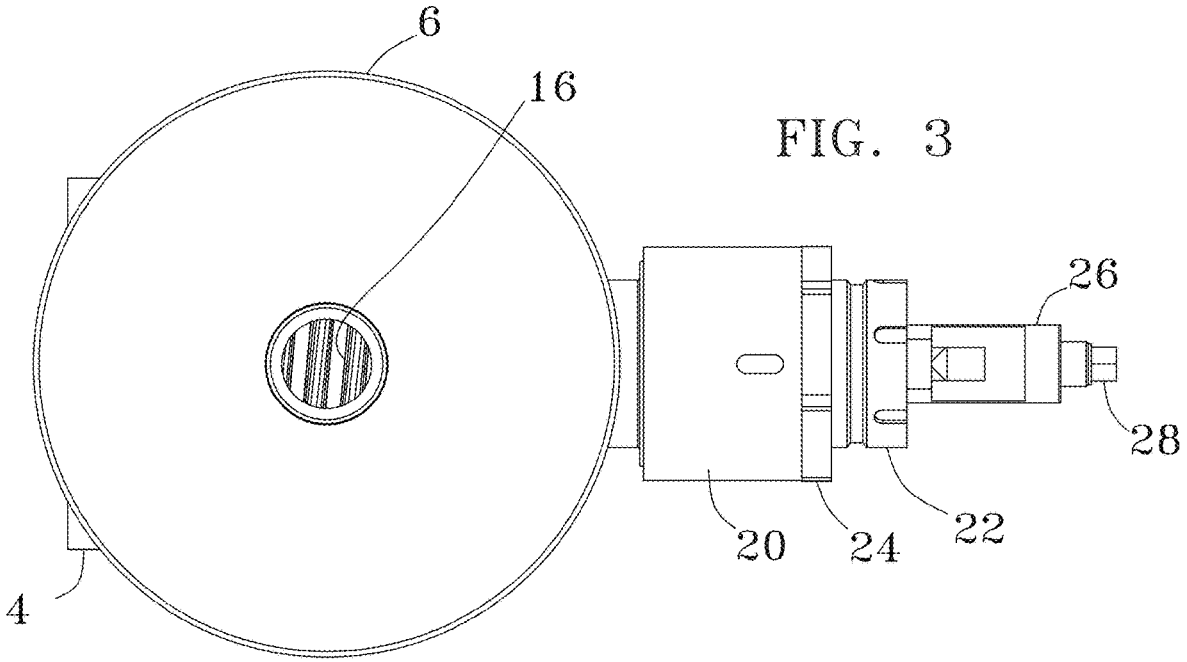
Figure 4:
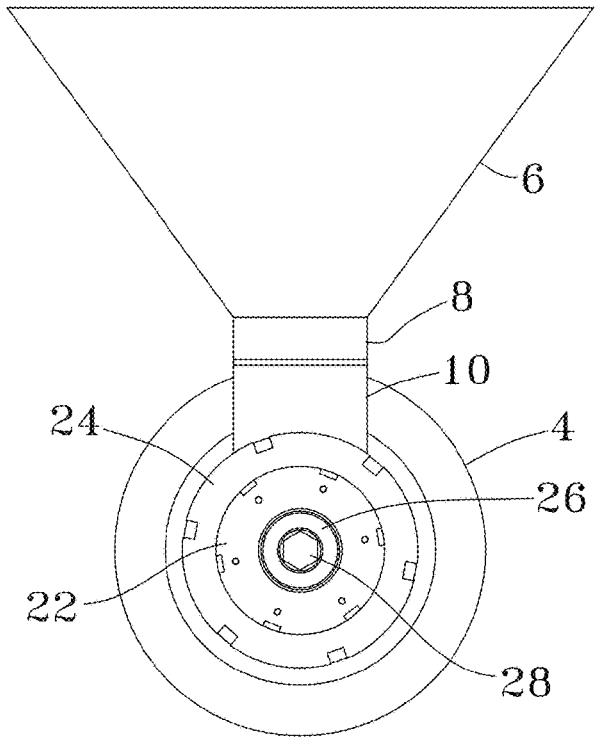
Figure 5:
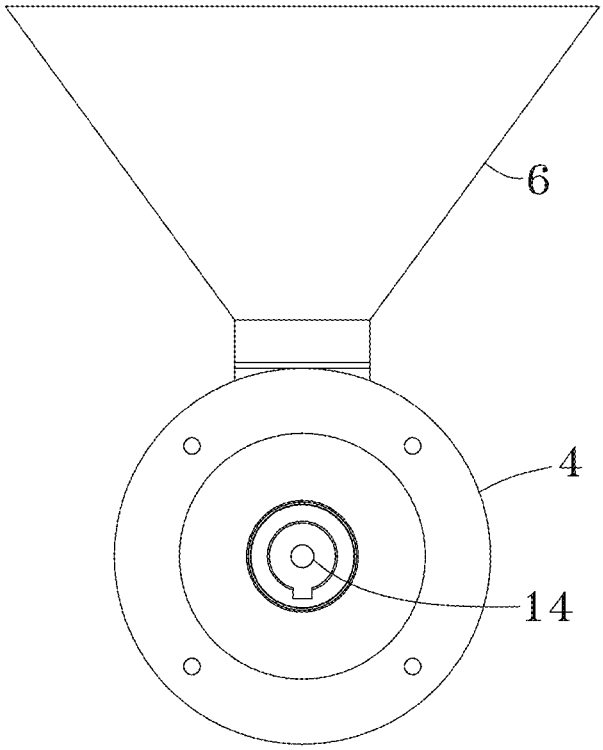
Figure 6:
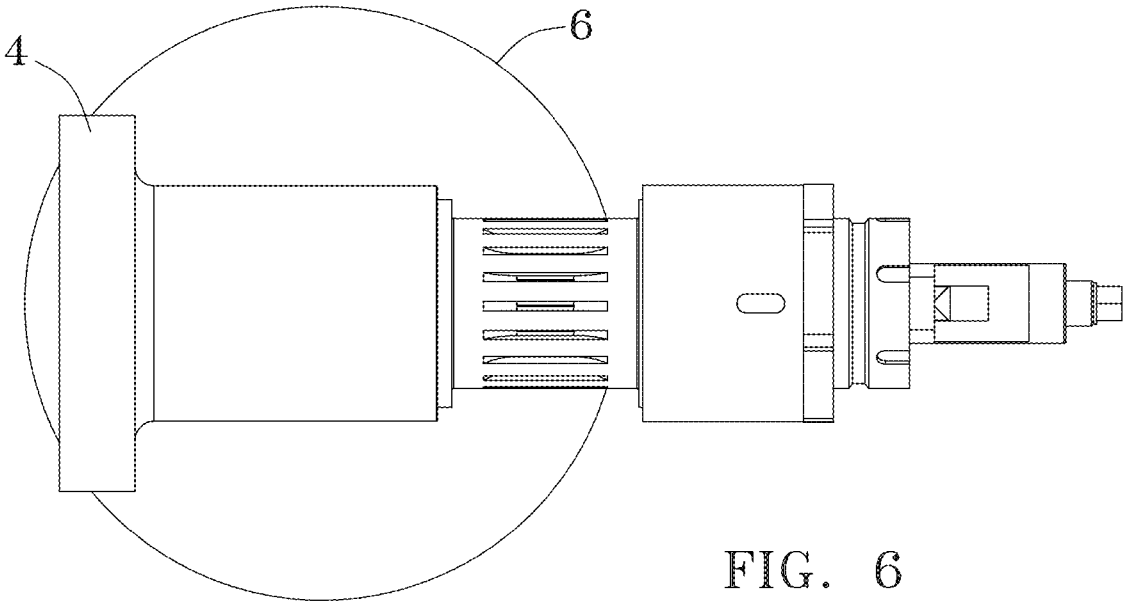

While various aspects and features of certain embodiments have been summarized above, the following detailed description illustrates at least on exemplary embodiment in further detail to enable one skilled in the art to practice such an embodiment. The described example is provided for illustrative purposes and is not intended to limit the scope of the invention.

In the following description, for the purposes of explanation, numerous specific details are set forth in order to provide a thorough understanding of the described embodiment. It will be apparent to one skilled in the art, however, that other embodiments of the present invention may be practiced without some of these specific details. While various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The terms "distal" and "proximal" as used herein in reference to the various components or component parts of the device, relates to the designation of the driven end of the seed oil expeller press as the distal end and the seed ejection end of the seed oil expeller press as the proximal end. The end or face of the various components may be termed "distal" or "proximal" with respect to their proximity to the distal or proximal end of the device.

The term "extending normally" as used herein, refers to a geometric relationship between two joined parts such that there is an approximate 90 degree angle there between these two parts.

The present invention is a seed oil expeller press ("press") for the extraction of oil from seeds through a pressing force that does not crush or physically grind the seeds or raise the temperature of the extracted oil over 130 degrees F., and leaves the seed bodies intact after oil extraction.

It is to be noted the seed oil expeller press is discussed extracting oils from seeds, however the extraction process and press disclosed herein may be used to express desirable natural oils residing within plant material. "Oil" as used in this specification is not limited to the chemical definition of non-polar liquid, but includes here any liquid, emulsion, plant sap, grease, butter, resin, tar, juice, and any substantially viscous matter which resides in material fed into a press and extracted by mechanical distortion of said matter.

The seed oil expeller press includes a hopper or feedstock collection means, a pressing mechanism, and separate exits for the desirable oils and for the solid matter depleted of its desirable products. Typical plant matter fed into the machine for processing includes but is not limited to: seeds, fruits, flowers or buds, roots or tubers, pods, leaves, or stalks. Often such matter may be chopped or shaped by other machines in preparation for processing by the press.

The seed oil expeller press 2 disclosed herein is driven preferably by a 220 volt, single phase, variable frequency electric motor (running at 40-50 Hz) mechanically coupled to a gear reducer, preferably one with a 1439/39 reduction ratio. The press is operated at very low speed, in the range of 7 to 14 rpm, depending on the type of seed. These driver components are well known in the art and do not comprise any of the claimed elements of the seed oil expeller press.

The present invention is a slow speed seed oil expeller press having a novel design that maximizes the compressive forces put on the seed and eliminates the shear forces put on the seed by eliminating the rotation of the seeds once introduced into the head volume of the press. In this way there is no abrading of the seeds against the walls of the press cavity. The compressed seeds exit the press in a hardened waste curl, with up to 95% of their original oil content removed, but with the seeds intact rather than torn open or ground into particles. The press is tunable, in that the pressure of compression and temperature of extracted seed oil may be adjusted by altering the seed feed rate (via the speed of motor and the size of the thorn orifice); the pressure cavity volume (via the gap between the expeller and the head surfaces); the amount of seed preheat (via the temperature applied to the head). The resultant extracted seed oil does not need to be filtered and does not undergo oxidation and catalytic conversion, common with the extracted seed oils produced by conventional seed oil expeller presses.

Figure 7:
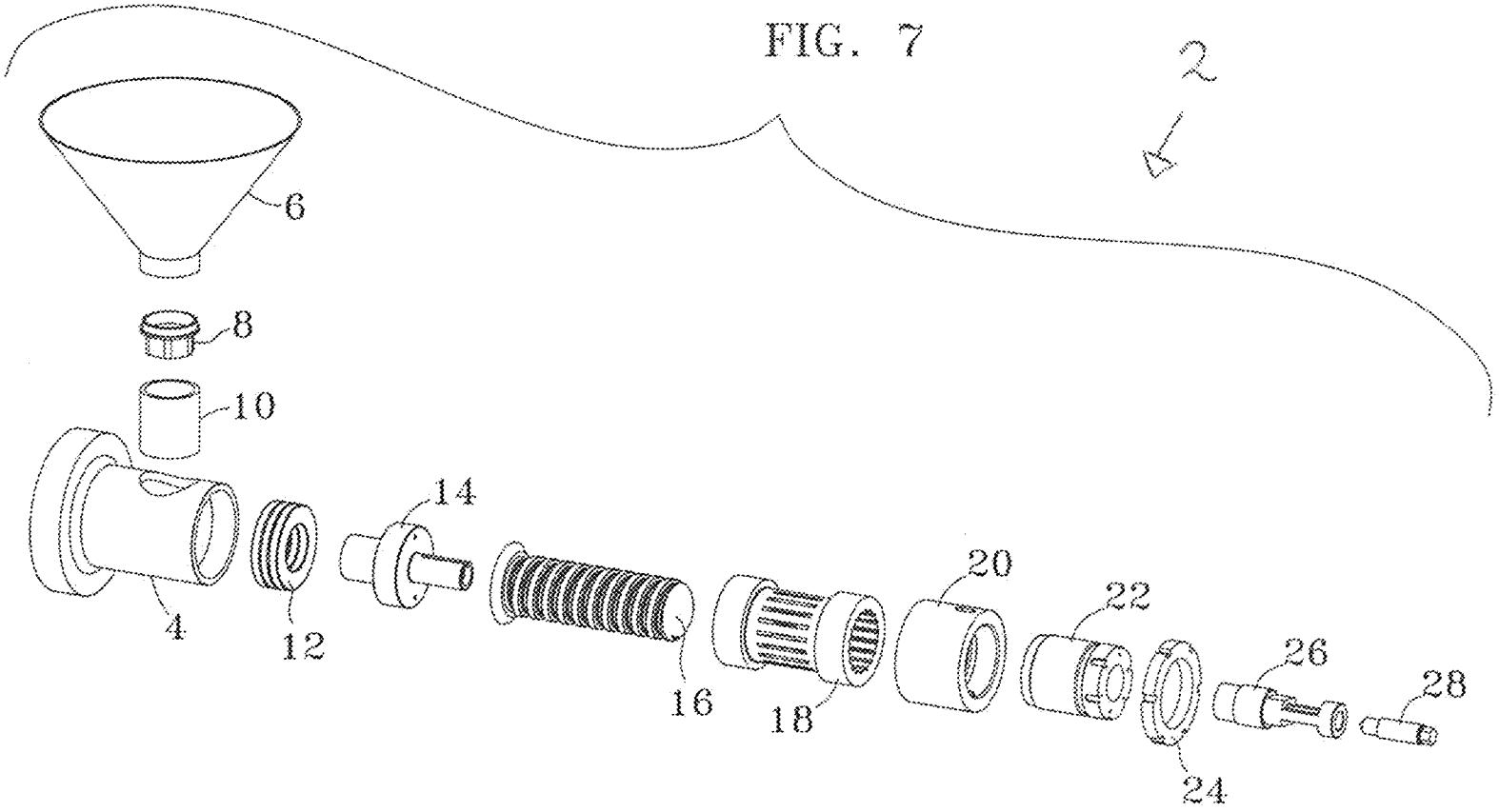
FIG. 7 is side perspective assembly view of the seed oil press.
Figure 11:
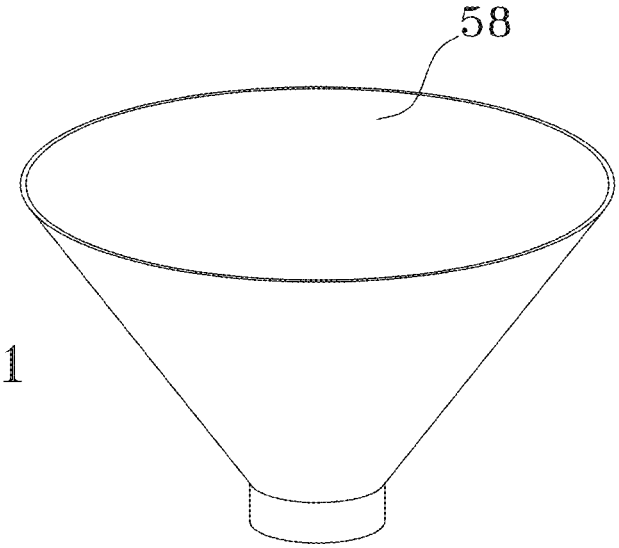
Figure 12:
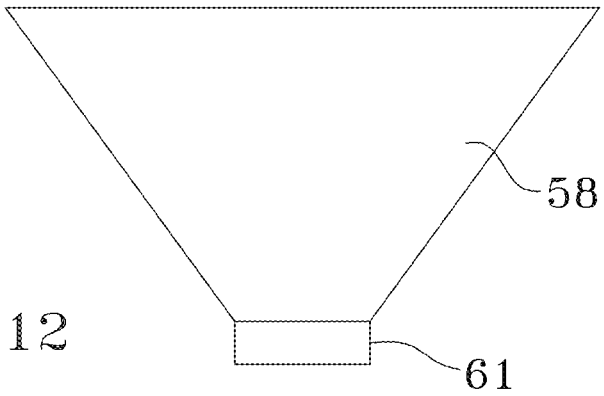
Figure 13:
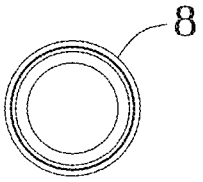
FIGS. 13-17 are top, perspective, perspective cross sectional, right side and left side views of the support bushing.
Figure 14:
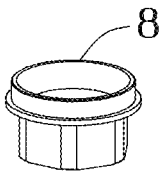
Figure 15:
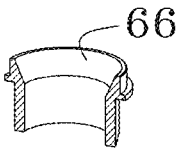
Figure 16:
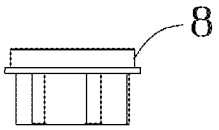
Figure 17:
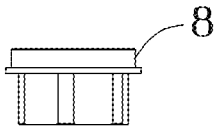
Figure 18:
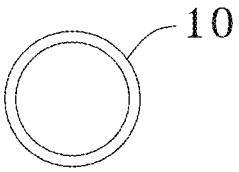
FIGS. 18-22 are top, perspective, perspective cross sectional, right side and left side views of the hopper support.
Figure 19:
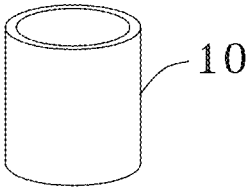
Figure 20:
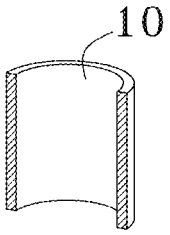
Figure 21:
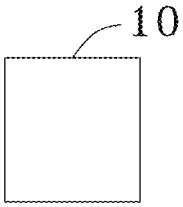
Figure 22:
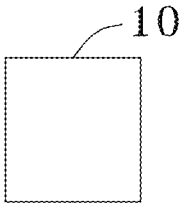
Figure 23:
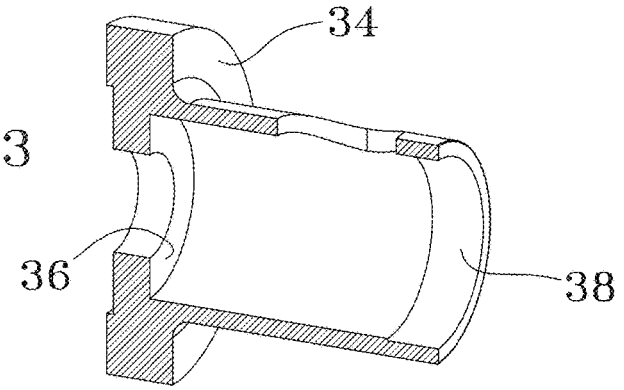
FIGS. 23-27 are side perspective cross sectional, left side, side perspective, right side and front views of the main housing.
Figure 25:
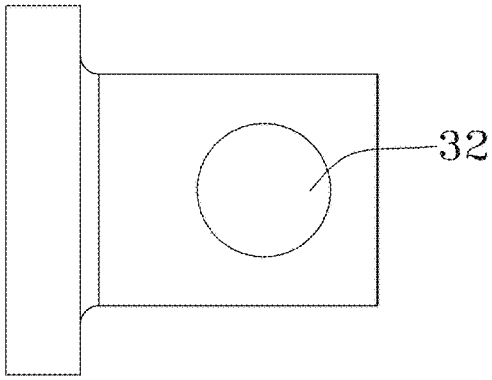
Figure 24:
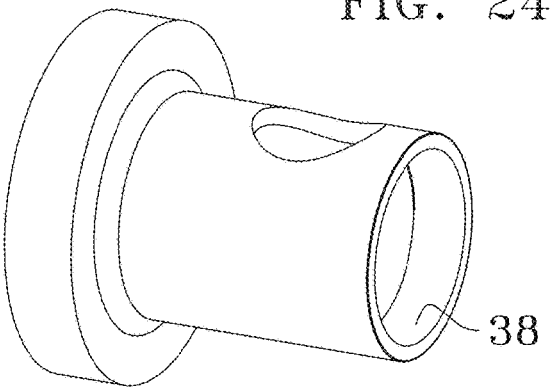
Figure 26:
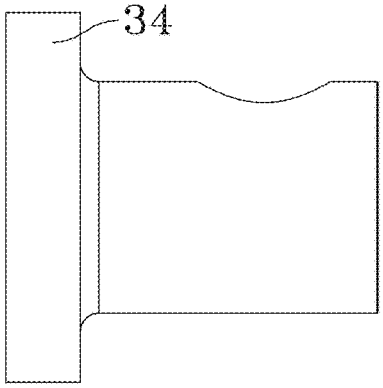
Figure 27:
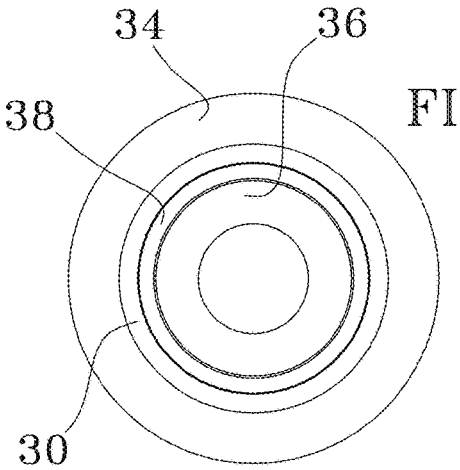
Figure 28:
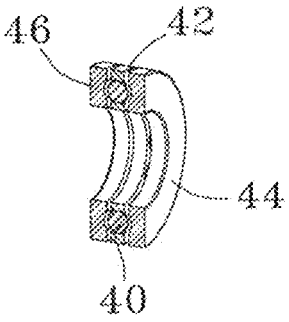
FIGS. 28-32 are side perspective cross sectional, left side, side perspective, right side and front views of thrust bearing.
Figure 29:
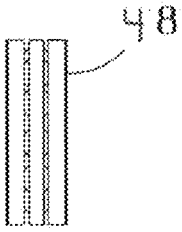
Figure 30:
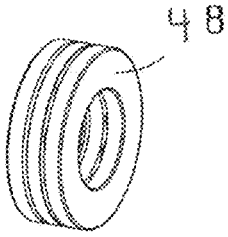
Figure 31:
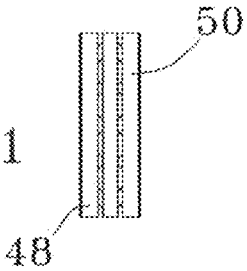
Figure 32:
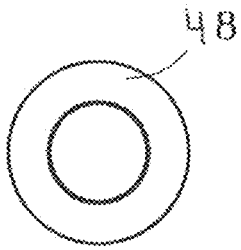
Figure 33:
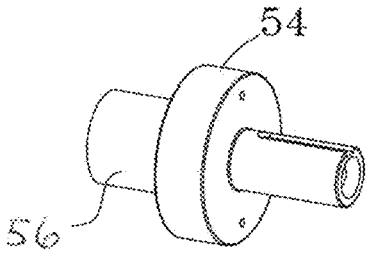
FIGS. 33-39 are side perspective, side perspective cross sectional, top, front, left side, back and right side views of the bearing support.
Figure 34:
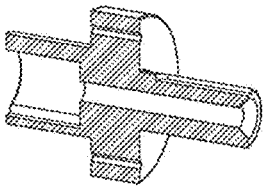
Figure 35:
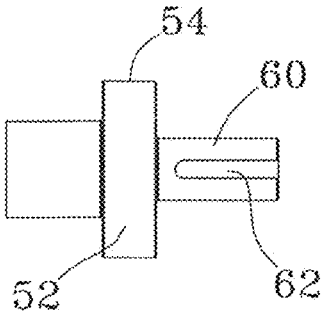
Figure 36:
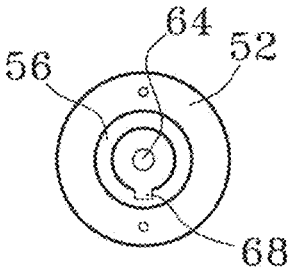
Figure 37:
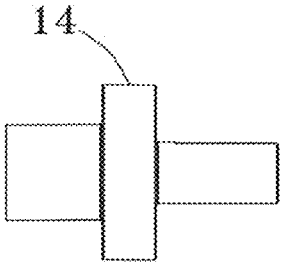
Figure 38:
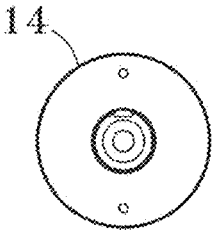
Figure 39:
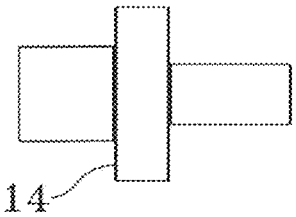
Figure 40:
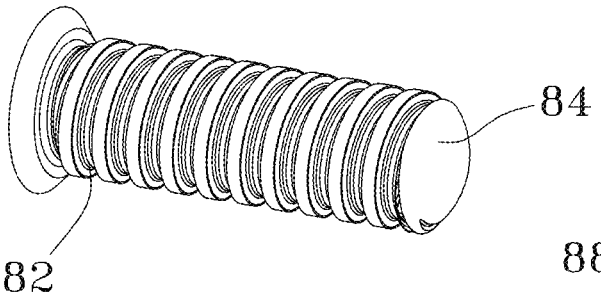
FIGS. 40-45 are side perspective, side perspective cross sectional, top, back, side and front views of the expeller.
Figure 41:
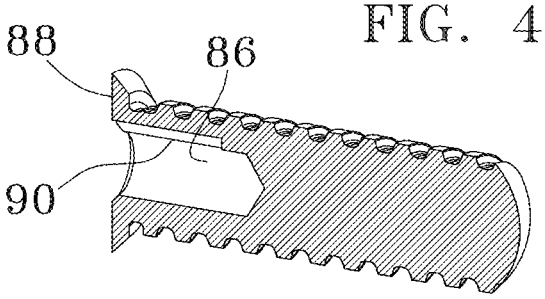
Figure 42:
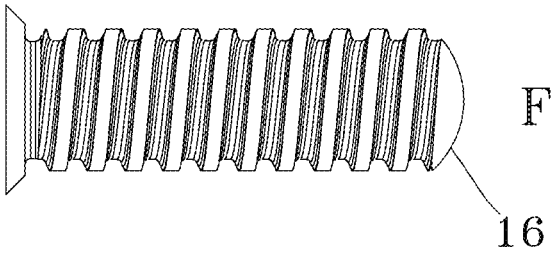
Figure 43:
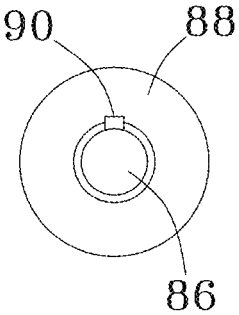
Figure 44:
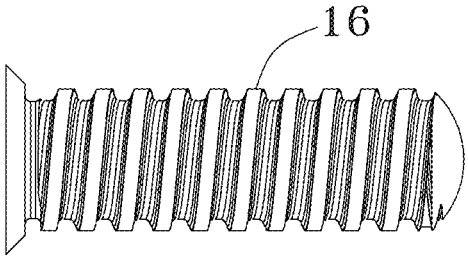
Figure 45:
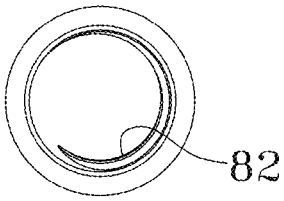
Figure 65:
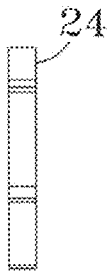
FIGS. 65-68 are left side, side perspective, front, right side, back, and right side views of lock ring.
Figure 66:
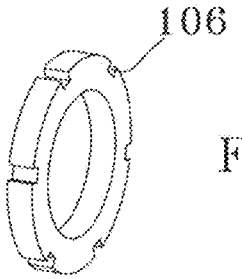
Figure 67:
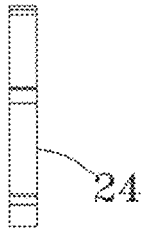
Figure 68:
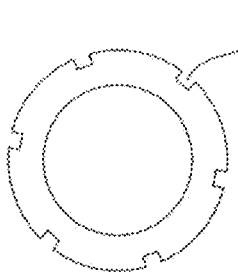
Figure 70:
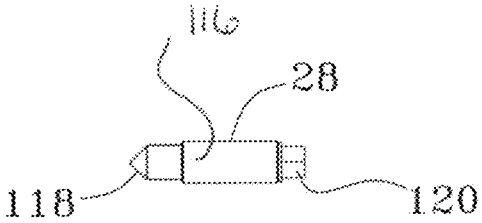
FIGS. 69-73 side perspective, left side, front, right side and back views of the thorn.
Figure 69:
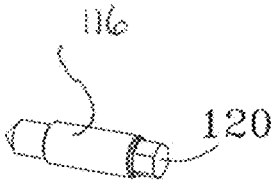
Figure 71:
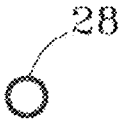
Figure 72:
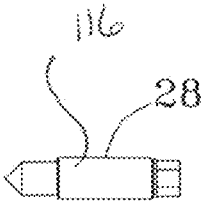
Figure 73:
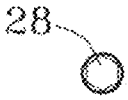
Figure 74:
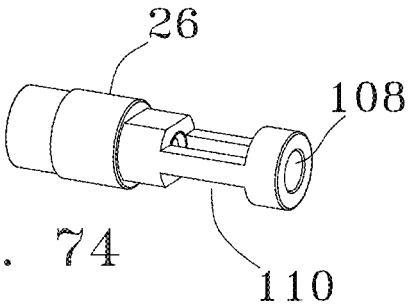
FIGS. 74-81 are front perspective, rear perspective cross sectional; rear perspective, front perspective cross sectional, top, front, side and back views of the thorn housing.
Figure 75:
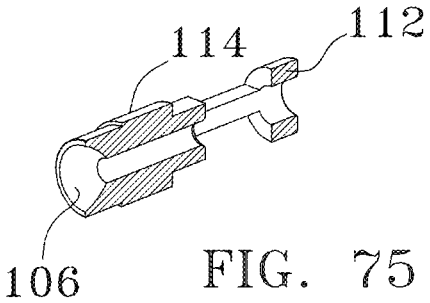
Figure 76:
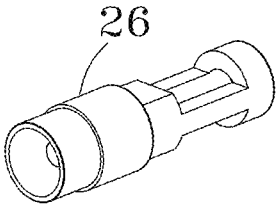
Figure 77:
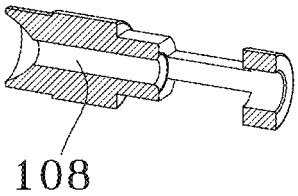
Figure 78:
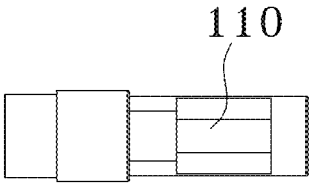
Figure 79:
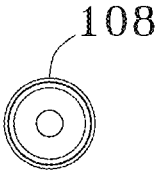
Figure 80:
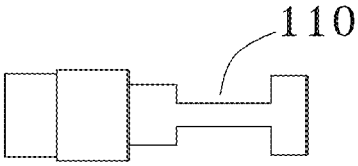
Figure 81:
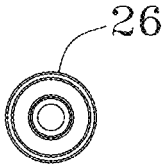

Looking at FIG. 7, it can be seen that the seed oil expeller press ("press") 2, has approximately 10 components and a three part seed introduction means (excluding mechanical fasteners such as bolts nuts keys and the like.) They are from the distal (driven) end of the press 2 to the proximal end: main housing 4; hopper 6; support bushing 8; hopper support 10; thrust bearing 12; bearing support 14; expeller 16; transfer housing 18; head collar 20; press head 22; lock ring 24; thorn housing 26; and thorn 28. These parts will be herein be described from the distal to proximal end of the press 2 and then their functional operation hereinafter described.

The main housing 4 can best be seen with reference to FIGS. 23-27. The main housing 4 is a cylindrical body 30 with a cylindrical feed bore 32 through its side wall for the feed of seeds through a mounted seed introduction means and a flange 34 extending normally outward from the distal end of the cylindrical body 30. This flange 34 serves as the connection point to a motor/gearbox drive combination (not illustrated) which is rigidly affixed in some fashion to a frame secured to the ground. The mechanical connection at the connection point is generally accomplished by passing mechanical fasteners (bolts and nuts) through apertures formed through the flange 34 that align with mating apertures in a flange on the gearbox end of the motor/gearbox drive combination. There is also a circular thrust disk 36 extending normally inward from the distal end of the cylindrical body 30. This thrust disk 36 serves as a bearing surface for the distal face of thrust bearing 12. (FIGS. 28-32) There is a cylindrical groove 38 formed about the inner periphery of the proximal end of the main housing 30 that serves as a riding surface for the bearing support 14 (FIGS. 33-39).

Frictional fit into the distal end of the interior of the main housing there is a replaceable thrust bearing 12. (FIGS. 28-32) This bearing may be any of a suitable type of circular mechanical thrust bearings from oil impregnated metal plain bearings to single or double row roller or ball bearings. Preferably, the thrust bearing 12 will be a single ball bearing having a series of balls 40 held between a front race 44 and a back race 46 by a separator cage 42. (Lubricant and seals may also be utilized depending on the make, manufacturer application and design of the bearing.) The outer race will have a planar distal face 48 and a parallel proximal face 50. The thrust bearing 12 will be under compressive load along its linear axis as its distal face 48 contacts the proximal face of the thrust disk 36 and its proximal face 50 contacts the distal face of the bearing support 14. The thrust bearing 12 allows for the rotation of certain press components within the compressional assembly of the press 2 along its lineal axis, The compressive forces along the linear axis of the press are transmitted onto the parallel faces of the thrust bearing 12.

Into the proximal end of the main housing 4 is frictionally fitted the bearing support 14. (FIGS. 33-39) This is a solid circular cylindrical disc 52 sized for mating engagement about its outer face 54 with the cylindrical groove 38 formed about the inner periphery of the proximal end of the main housing 4. From the distal end of the bearing support normally extends a socket 56 with a first internal keyway 58 cut there along its inner face, parallel with the linear axis of the bearing support 14. This internal first keyway 58 is used for the constraint of a first key shared with first external keyway formed on the exterior drive shaft of the gearbox and rotationally couples the motor/gearbox assembly to the press 2 when this drive shaft is inserted into the matingly conformed and sized socket 56. From the proximal end of the bearing support 14 extends normally a circular, cylindrical shaft 60 with a second external keyway 62 formed parallel to the linear axis of the bearing support 14. This second external keyway 62 houses a second key (not shown for visual clarity) to lock the rotation of the bearing support 14 to the expeller 16 via a second internal keyway cut into the expeller press's interior. There is a linear through bore 64 in the bearing support that resides about and parallel its linear axis.

The seed introduction means is made of three parts (hopper 6 FIGS. 8-12, support bushing 8 FIGS. 13-17, and hopper support 10 FIGS. 18-22) The hopper 6 is but a funnel 58 having a circular flange 61 at its base that is sized for frictional insertion into a tapered internal groove 66 formed in the top end of support bushing 8. This insertion engagement supports the hopper 6 on the main housing 4 with the hopper's linear axis passing through the approximate center of the feed bore 32. There is a hopper support 10 that is a hollow right cylindrical body extending upwards from the main housing 4 and that internally accepts the bottom end of the support bushing 8.

A transfer housing 18 lies between the main housing 4 and the head collar 20. In the preferred embodiment the distal and proximal ends of the transfer housing 18 have external threads which engage matingly conformed internal threads on the proximal end of the main housing 4 and internal threads on the distal end of the head collar 20. (Threads are omitted on the drawings for visual clarity and are known as one of numerous methods of attachment available between these components, such as rivets, bolts, pins and the like. Threads are eliminated from all FIGS. except FIG. 82). FIGS. 46 to 51 illustrate that the transfer housing 20 is a hollow, cylindrical member with a series of equally radially spaced linear slits 64 approximately 0.5 mm wide, cut through the center region 66 of its side wall and residing parallel to the linear axis of the press 2. This central region 66 has a smaller cross-sectional diameter than the distal end 68 and proximal end 70 of the transfer housing 18. It is through these linear slits 64 that the expelled oil seeps and drips into a collection vessel placed below.

The head collar 20 connects the proximal end of the transfer housing 18 to the distal end of the press head 22. The head collar is a circular cylinder having a distal set of internal threads matingly conformed to the external threads formed on the proximal end of the transfer housing 18 as well as a proximal set of internal threads matingly engageable with the external threads formed on the outer face of the distal end of the head 22. As FIGS. 52-56 shows, the interior circular bore 72 of the head collar has a circular internal shoulder 74 extending inward centrally therein. Adjacent this internal shoulder 74 is an annular groove 80. The distal portion of the bore 76 behind the internal shoulder 74 has a larger diameter than the proximal portion of the bore 78 forward of the annular groove 80. The internal shoulder 74 acts as a physical stop for the insertion of the expeller 16 into the head collar 20.

Looking at FIGS. 40-45, the expeller 16 can best be explained. The expeller 16 is a solid body with a single helical feed groove 82 formed about its outer side wall, and a convex proximal end 84 that has been both hardened and polished to a mirror like finish. There is a stopped bore 86 formed parallel to its linear axis that extends inward from the distal end of the expeller 16. There is a tapered flange 88 formed at the distal end of the expeller 16. The stopped bore 86 has a second internal keyway 90 formed along the length of the stopped bore 86 is sized for the frictional insertion of a second key (not shown for visual clarity) with the circular, cylindrical shaft 60 of the bearing support 14 to lock the rotation of the bearing support 14 to the expeller 16.

In component assembly, the transfer housing 18 is threadingly engaged with the main housing 4 and rotated to draw the two together so as to push the expeller 16 at its tapered flange 88 down into the main housing until the tapered flange 88 formed at the distal end of the expeller 16 contacts the proximal face of solid circular cylindrical disc 52 of the bearing support 14 and forces the bearing support 14 into contact with the proximal face 50 of thrust bearing 12 moving the entire assembly backwards until the distal face 48 of the thrust bearing contacts the circular thrust disk 36 extending normally inward at the distal end of the main housing 4. (Alternately the bearing support 14 and expeller 16 may be connected via a bolt passing through the socket 56 and engaging internal threads formed therein.) The transfer housing is continually threaded downward (toward the distal end of the press 2) until there is a sufficient compressive force exerted onto the thrust bearing 12, and the thrust bearing 12, the expeller 16, the transfer housing 18, the head collar 20 are drawn into operational tolerances and their centerlines are collinear with the linear axis of the press 2.

FIGS. 57-64 show the novel design of the press head 22. The press head 22 is a circular cylindrical solid body having a set of external threads formed along its outer side wall 92 (illustrated in FIG. 83) and a concave, knife edged face 94 formed in its distal end. The concavity of this distal end mirrors the convexity of the proximal end 84 of the expeller 16.

The knife edged concave face 94 has an outer periphery ring 94 and an inner periphery ring 93 formed around its central orifice 97. Evenly radially spaced concave troughs 96 are cut into the distal end's concave knife edged face that are deepest at the outer periphery 91. The concave troughs 96 do not extend to the inner periphery ring 93 or central orifice 97. The concave knife edged face 94 is the series of evenly radially spaced raised curved segments 98 remaining between the troughs 96. These raised curved segments 98 thus do not extend to the central orifice 97 or the inner periphery ring 93, but rather end in the buffer space 99 between the inner end of the troughs 96 and the inner periphery ring 93. This concave knife edged face 94 has sharp edges 91 (at a minimum included angle of 90 degrees) formed along the length of the two sides of their curved faces. It also has sharp corners 95 (having a minimum included angle of 90 degrees between all adjacent sides). These sharp corners 95 are where the outer periphery ring 94 meets the outer end of the raised curved segments 98 and outer end of the concave troughs 96. These troughs 96 and curved segments 98 are dimensioned for depth and the space between them so as to minimize or eliminate the rotation of the agglomerated seed mass that is trapped in the troughs 96 and compressed in the gap between the expeller 16 and the press head 22. It is the construct of this design to have the agglomerated seed mass rotate slowly as one unit, to squeeze the oil out of the seeds rather than to tear and grind the seed bodies apart. The sharp edges 91 and corners 95 aid in grabbing the seed mass at multiple places to hold it together as long as possible during the compression. This is evidenced by adjusting the distance between the press head 22 and the expeller 16 until the pressed seed cake is seen comprised of flat, but whole seed bodies.

The curved segments 98 at their widest outer section at the outer periphery ring 94 are more than twice the width of the troughs 96. The troughs 96 have a uniform width whereas the curved segments 98 decrease in width from the outer periphery ring 94 to the inner periphery ring 93. Ending the curved segments in the buffer space 99 just before the inner periphery ring 93 before the central orifice 97 and providing the inner periphery ring 93 prevents tearing of the seeds as they exit the press head 22. This eliminates the requirement to filter the extracted oil for particulate. This knife edged faced configuration is responsible for the squeezing of the seeds rather than their tearing, ripping and grinding and crushing. This means less friction and lower oil extraction temperatures.

There is through bore 100 passing through the center of the press head 22 along its linear axis. This bore 100 is stepped along its length in two places so as to make three different diameter regions along the through bore 100. The first step 102 at the distal end serves as a shoulder that the distal edge of the thorn housing 26 abuts, allowing a smooth transition into the distal concave opening 106 of the thorn housing 26 from the press head 22 with no exposed edges for seeds to tear or grind onto. The second step 104 at the proximal end just increases the diameter of the bore to allow for internal threads from the second step 104 to the proximal end of the press head 22.

The press head 22 is affixed to the proximal end of the head collar 20 by a set of external threads about its outer side wall 92 (threads not illustrated for visual clarity) that engage the proximal set of internal threads formed at the proximal end of the head collar 22. Drawing these components together sets the size of the gap (head volume) between the convex proximal end 84 of the expeller 16 and the convex knife edged face 94 of the pressure head 22. There is a circular lock ring 24 (FIGS. 65-68) with internal threads on its inner face that matingly engage the external thread on the press head 22. This is used to lock the press head 22 into the correct depth to set the gap (the head volume) between the press head 33 and the expeller 16. Once the press head 22 has been threaded down into the head collar 20 to achieve the desired thickness of gap the lock ring 24 is threaded tightly down the outside of the press head 22 until the lock ring firmly contacts the proximal end of the head collar 20 so as to frictionally constrain the press head 22 from moving relative to the head collar 20. The lock ring 24 undergoes its final tightening by insertion of a punch into any of the slots 108 formed about the periphery of the lock ring 24 and rapping the punch with a hammer.

The thorn housing 26 (FIGS. 74-81) is a circular cylindrical body having a through slots 108 centered along its linear axis with two cutaway side wall sections that open into the through slots 108 to form a pair of axial seed exit orifices 110, a distal concave opening 106, a set of external threads formed about its largest diameter stepped side wall 114, and a proximal internally threaded end 112. (Threads are not shown for visual clarity.) The external threads of the thorn housing 26 threadingly engage the internal threads from the second step 104 to the proximal end of the pressure head 22. Then threaded this engagement pushes the thorn housing 26 down the press head 22 until the edge of the concave opening 106 abuts the shoulder at the first step 102 at the distal end of the press head 22. Although depicted with only two axial seed exit orifices, it is known that there could be other configurations with more than two seed exit orifices.

Into the proximal end of the thorn housing 26 is threadingly engaged a thorn 28. The thorn 28 is just an adjustable depth plug with external threads about its distal side wall 116 for advancing it into the through slots 108 of the thorn housing past the proximal end of the two seed exit orifices 110. (Threads not shown for visual clarity.) At its distal end is a conical point 118 for splitting the seed conglomeration and directing it out of the two seed exit orifices 110. The proximal end of the thorn 28 is a hexagonal stud 120 for the attachment of a wrench to turn and insert the thorn 28 into the thorn housing 26. The depth that the thorn 28 is inserted determines the effective seed exit orifice 110 sizes thus adjusting the pressure the seed agglomeration undergoes in the press head 22.

There are optional electric seed pre-heaters strapped around the head collar 30 so as to warm the incoming seeds softening the seed shell and inner content. As an unexpected result of running the press 2 at a slow speed, using a knife edge faced press head 22, and heating the seeds before compression, the seed oil is extracted with a lower overall oil temperature than not pre-heating the seeds. This is because the physical process of compressing the seeds does not gain temperature from the extra pressure that must be added to tear, rip, and grind the seeds to extract the oil.

Looking at FIGS. 1-6 the assembled seed oil expeller press 2 can be seen from all angles, showing the arrangement of its components.

In operation, (with reference to FIG. 82 for the spacing relationships between the assembled components) the hopper 6 is filled with seeds, the thorn depth in the thorn housing 26 is set, the gap between the expeller 16 and the press head 22 are set (variable with type of seed but approximately 0.75-1 mm), the pre-heating blankets and press head 20 are brought to the proper temperature (approximately 110 degrees F.), the variable frequency motor (40-50 HZ) is started and the gearbox speed reduction (approximately 1439/39) set for proper rotational speed (>20 rpm preferably 7-14 rpm). Seeds are fed down into the seed introduction means and enter the main housing 4 aligning themselves into the helical feed groove 82 of the rotating expeller 16. This propels the seeds along the transfer housing 18 toward the proximal end of the press 2. As the seeds reach the proximal end of the expeller 16 they gather in the head space (the space between the polished, convex proximal end 84 of the expeller 16 and the convex knife face 94 of the press head 22 where they are warmed and compressed in front of the incoming continual seed feed. They form a seed conglomeration (or puck) as they compress and begin to release their oil (which flows backward through the expeller and drips out axial linear slits 64 in the transfer housing 20). The seed conglomeration does not rotate in the head space. Its compression and early loss of oil because of the pre-heating, makes the seed conglomeration into a dry mass, hard enough to remain together as a solid disk. The sharp edges on the concave bars 98 of the press head 22 grab the seed conglomeration, therein preventing it from rotating and abrading on any surfaces. The polished face of the expeller 16 eliminates any rotational force transmitted from the expeller 16 to the seed conglomeration. The seeds are pressed, not grinded, torn or ripped. Thus, no particulate is transferred to the seed oil and the seed oil temperature is not raised by friction between the seeds and the press head or expeller surfaces. At a certain point the pressure of the seeds forces the center of the seed conglomeration to fold inward toward the bore 100 of the press head 22 and then down the thorn housing 26 until it contacts the conical point 118, curls and exits via the seed exit orifices 110. The resultant extracted oil will be less than 130 degrees F., free of organic particulate matter and metal chips, and will not have undergone oxidation and catalytic conversion.

With respect to the tunability of the press 2, the amount of force exerted on the seeds in the head space determines the seed oil temperature and the percentage of total oil that is extracted from the seeds. This is adjusted by the depth the thorn 28 is inserted into the thorn housing 26 in relation to the speed of the seed feed (motor speed). These are varied by the amount of heat input to the seeds prior to compressing as well as the head volume (set by the distance between the expeller 16 and the press head 22).

Figure 82:
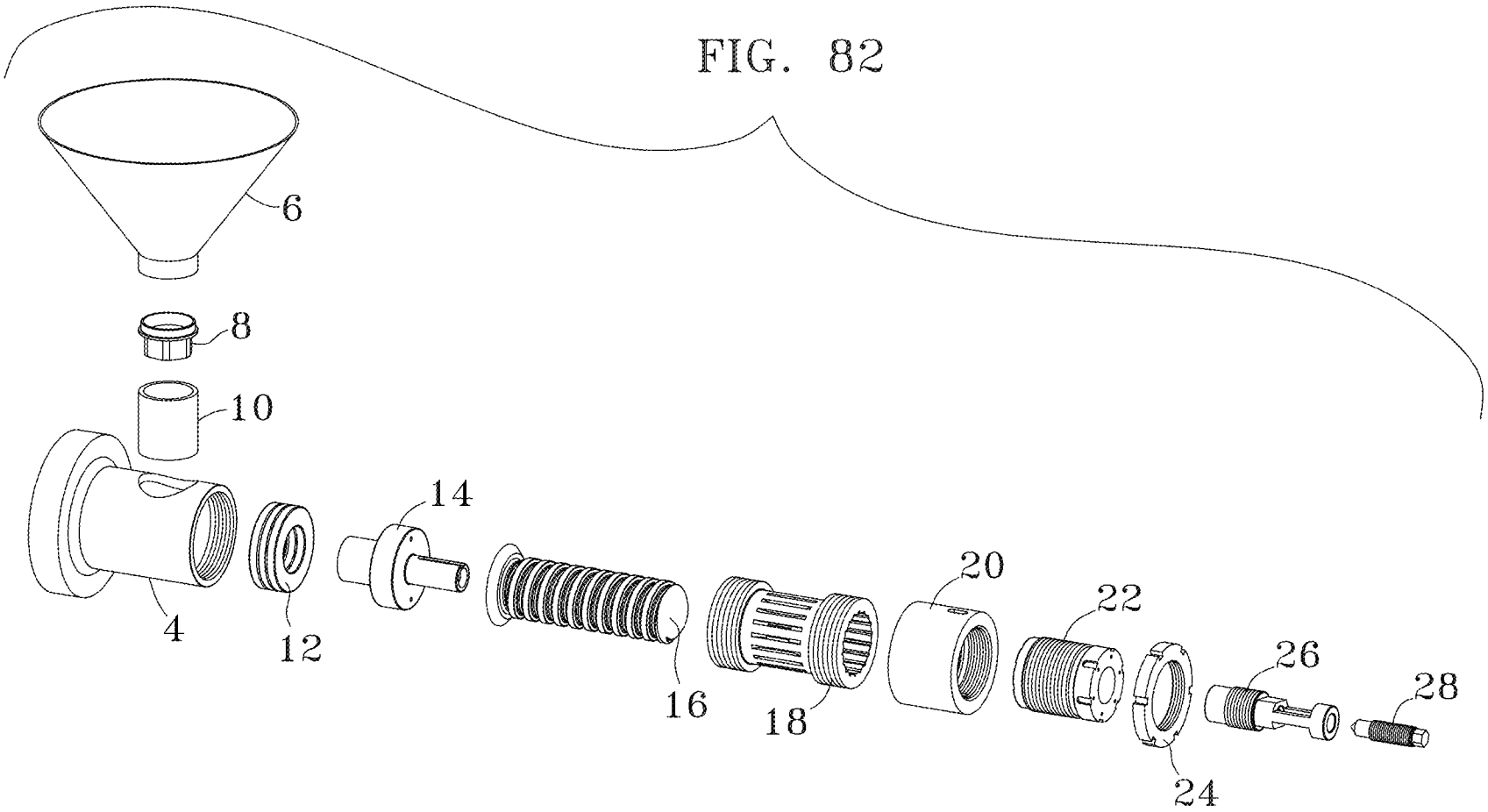
FIG. 82 is an assembly view of the seed oil press showing the threaded connections.
Figure 83:
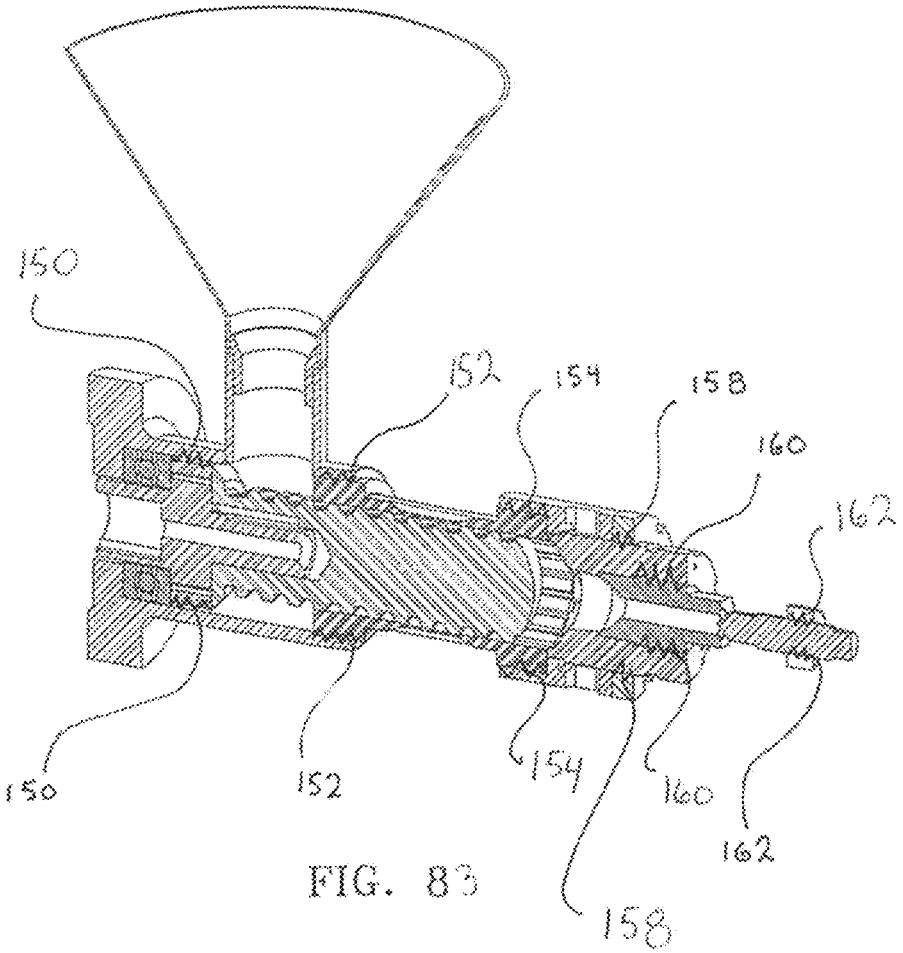
FIG. 83 is a cross sectional view of the press showing the threaded connections in assembly.

Looking at FIGS. 82 and 83 the following threaded connections (eliminated for the other figures for visual clarity can be seen: the main housing/bearing support threads 150, the main housing/transfer housing threads 152, the transfer housing/head collar threads 154, the head collar/press head threads 156, the press head/lock ring threads 158, the press head/thorn housing threads 160, the thorn housing/thorn threads 162.

The unrivaled success of this press 2 is due to the synergistic effect of the adjustable thorn, the strap on preheaters, the variable speed motors, the polished expeller the knife faced press head, and the adjustable head volume. These parameters in combination allow for the adjustment of the temperature, pressure and volume of seeds processed.

While certain features and aspects have been described with respect to exemplary embodiments, one skilled in the art will recognize that numerous modifications are possible. Consequently, although at least one exemplary embodiment has been described above, it will be appreciated that the invention is intended to cover all modifications and equivalents within the scope of the following claims.

Having thus described the invention, what is claimed as new and desired to be secured by Letters Patent is as follows:

1. A tunable seed oil expeller press comprising:

a main housing having a flanged distal back, an open proximal front and a top orifice;

a bearing support rotatably housed within said main housing;

a thrust bearing having a first side in contact with said flanged distal back of said main housing and a second side in contact with said bearing support;

a seed introduction means for introducing seeds into said main housing, said seed introduction means extending vertically from said top orifice of said main housing;

a transfer housing having a front end and a back end, said back end threadingly engaged in said proximal end of said main housing;

a head collar having a forward end and a rear end, said rear end threadingly engaged into said front end of said transfer housing;

a press head having an outer periphery ring, an inner periphery ring formed at a central orifice, a concave face, and a series of evenly radially spaced concave troughs formed there below said concave face, said concave troughs are deepest at said outer periphery and not extending to said inner periphery ring, wherein a plurality of knife edges and corners formed on a series of raised curved segments left between said troughs on said concave face, wherein said press head is depth adjustably engaged into said forward end of said head collar;

a thorn housing with at least two pressed seed exit orifices formed axially therethrough, said thorn housing threadingly engaged into said press head;

a depth adjustable thorn threadingly engaged into said thorn housing, said thorn extending between said two seed exit orifices; and an expeller rotationally disposed in said transfer housing between said press head and said bearing support, wherein said bearing support extends into a stopped bore formed in said expeller and is rotationally locked to said expeller; and wherein said expeller has a polished convex proximal end and said press head has the concave face at a distal end that is separated from the proximal end of said expeller by an adjustable head space, wherein a concavity of the distal end of said press head mirrors the convexity of the proximal end of said expeller.

2. The tunable seed oil expeller press of claim 1 wherein said concave troughs of said press head have a uniform width and said raised curved segments have width that decreases nearer said central orifice.

3. The tunable seed oil expeller press of claim 1 further comprising a lock ring threadingly engaged about said press head, said lock ring in contact with said forward end of said head collar.

4. The tunable seed oil expeller press of claim 1 further comprising a series of axial linear slits formed through said transfer housing.

5. The tunable seed oil expeller press of claim 1 wherein said thorn has a first end and a second end, said first end having a conical point formed thereon and said second end having a hexagonal stud formed thereon said thorn.

6. The tunable seed oil expeller press of claim 1 wherein said press head is threadingly engaged into said front end of said head collar so as to rotationally adjust said head space.

7. The tunable seed oil expeller press of claim 1 wherein said top orifice in said main housing is formed therethrough from which extends a cylindrical body hopper support, and said seed introduction means is comprised of a funnel having a circular flange extending therefrom that is frictionally inserted into a tapered internal groove formed in a top end of a support bushing that is inserted into said hopper support such that said funnel and said support bushing reside on the main housing with a linear axis of said funnel passing through a center of said top orifice.

8. The tunable seed oil expeller press of claim 7 wherein there is a through bore along a linear axis of said press head, said through bore stepped at a distal end so as to serve as a shoulder that a distal edge of said thorn housing abuts, allowing transition into said thorn housing from said press head.

* * * * *